US009962760B2

(12) United States Patent
Tanaka et al.

(10) Patent No.: US 9,962,760 B2
(45) Date of Patent: May 8, 2018

(54) TITANIUM SLAB FOR HOT ROLLING PRODUCED BY ELECTRON-BEAM MELTING FURNACE, PROCESS FOR PRODUCTION THEREOF, AND PROCESS FOR ROLLING TITANIUM SLAB FOR HOT ROLLING

(75) Inventors: Hisamune Tanaka, Chigasaki (JP); Norio Yamamoto, Chigasaki (JP); Takeshi Shiraki, Chigasaki (JP); Takashi Oda, Chigasaki (JP); Yoshimasa Miyazaki, Tokyo (JP); Yoshihiro Fujii, Tokyo (JP); Kazuhiro Takahashi, Tokyo (JP)

(73) Assignees: TOHO TITANIUM CO., LTD., Kanagawa (JP); NIPPON STEEL & SUMITOMO METAL CORPORATION, Tokyo (JP)

( * ) Notice: Subject to any disclaimer, the term of this patent is extended or adjusted under 35 U.S.C. 154(b) by 1278 days.

(21) Appl. No.: 13/148,392

(22) PCT Filed: Feb. 8, 2010

(86) PCT No.: PCT/JP2010/051786

§ 371 (c)(1),
(2), (4) Date: Aug. 8, 2011

(87) PCT Pub. No.: WO2010/090310

PCT Pub. Date: Aug. 12, 2010

(65) Prior Publication Data

US 2011/0308291 A1 Dec. 22, 2011

(30) Foreign Application Priority Data

Feb. 9, 2009 (JP) ..... 2009-027313
Feb. 9, 2009 (JP) ..... 2009-027318

(51) Int. Cl.
*B22D 11/00* (2006.01)
*B22D 21/00* (2006.01)
(Continued)

(52) U.S. Cl.
CPC ..... *B22D 11/001* (2013.01); *B21B 3/00* (2013.01); *B22D 7/005* (2013.01); *B22D 11/041* (2013.01);
(Continued)

(58) Field of Classification Search
CPC ... B22D 11/001; B22D 11/04; B22D 11/0408; B22D 11/041; B22D 11/0631;
(Continued)

(56) References Cited

U.S. PATENT DOCUMENTS 3,447,592 A * 6/1969 Wertli ..... 164/443
3,764,297 A * 10/1973 Coad et al. ..... C22B 9/20 164/469
(Continued)

FOREIGN PATENT DOCUMENTS

DE 199 60 362 C1 5/2001
EP 0 896 197 B1 2/1999
(Continued)

OTHER PUBLICATIONS

Professional translation of JP 55-144307, published originally in Japanese on Nov. 11, 1980 (Nov. 11, 1980).*
(Continued)

*Primary Examiner* — Scott Kastler
*Assistant Examiner* — Vanessa T Luk
(74) *Attorney, Agent, or Firm* — Fitch, Even, Tabin & Flannery, LLP

(57) ABSTRACT

A titanium slab is appropriate for hot rolling, is produced by electron beam melting furnace, has superior linearity so that it can be fed into a hot rolling machine without performing
(Continued)

breaking down process or other subsequent correcting process after production, and has good structure having no cracks at the corner parts. A process for production thereof is also provided. The titanium slab is directly produced by a mold of an electron beam melting furnace, and has the deformation of not more than 5 mm for the thickness direction versus the longitudinal direction and deformation of not more than 2.5 mm for the width direction versus the longitudinal direction, both per a length of 1000 mm of the slab. The process for production of this titanium slab for hot rolling has a step of using an electron beam melting furnace in which its rectangular mold has mold walls of a long side and mold walls of a short side, and a step of pouring molten metal from one of the mold walls of a short side. Furthermore, a mold having chamfered parts at the corner parts can be used in the process.

5 Claims, 3 Drawing Sheets

(51) Int. Cl.

| | |
|---|---|
| ***B21B 3/00*** | (2006.01) |
| ***B22D 11/041*** | (2006.01) |
| ***B22D 7/00*** | (2006.01) |
| *B21B 1/26* | (2006.01) |
| *B21B 1/42* | (2006.01) |

(52) U.S. Cl.
CPC ..... *B22D 21/005* (2013.01); *B21B 1/26* (2013.01); *B21B 1/42* (2013.01); *Y10T 428/12389* (2015.01)

(58) Field of Classification Search
CPC ..... B22D 21/005; B22D 7/005; B21B 1/26; B21B 1/42; B21B 1/46; B21B 3/00; B21B 3/003; B21B 13/22; Y10T 428/12389
See application file for complete search history.

(56) References Cited

U.S. PATENT DOCUMENTS

| | | | | |
|---|---|---|---|---|
| 4,168,185 | A * | 9/1979 | Takisawa | B21B 3/00 72/227 |
| 5,224,534 | A | 7/1993 | Shimizu et al. | |
| 5,273,101 | A | 12/1993 | Lillquist | |
| 5,273,102 | A * | 12/1993 | Lillquist et al. | 164/452 |
| 5,972,282 | A | 10/1999 | Aguirre et al. | |
| 2002/0179278 | A1 | 12/2002 | Spadafora et al. | |
| 2004/0055733 | A1 | 3/2004 | Jackson et al. | |
| 2008/0105400 | A1 | 5/2008 | Shiraki et al. | |
| 2008/0230202 | A1 * | 9/2008 | Roehrig | B22D 11/128 164/444 |

FOREIGN PATENT DOCUMENTS

| | | | | |
|---|---|---|---|---|
| GB | 1 597 389 | A | 9/1981 | |
| JP | 55-144307 | A * | 11/1980 | B21B 1/38 |
| JP | S55-144307 | A | 11/1980 | |
| JP | 62-050047 | | 3/1987 | |
| JP | 62-077427 | | 4/1987 | |
| JP | 62-284049 | | 12/1987 | |
| JP | 04-131330 | A | 5/1992 | |
| JP | 04-284951 | A | 10/1992 | |
| JP | 4-319044 | | 11/1992 | |
| JP | 08-104961 | | 4/1996 | |
| JP | 08104961 | A * | 4/1996 | |
| JP | 11-28550 | | 2/1999 | |
| JP | 11-108556 | | 4/1999 | |
| JP | 11-108556 | A | 4/1999 | |
| JP | 2006-207838 | | 8/2006 | |
| JP | 2007-332420 | | 12/2007 | |
| KR | 10-0217943 | B1 | 6/1997 | |
| UA | 56 194 | C2 | 5/2003 | |

OTHER PUBLICATIONS

Chares Entrekin et al., Electron Beam Cast Titanium Slab, Proceeding of the 1984 Vacuum Metallurgy Processing, Jun. 11-13, 1984, Jan. 1, 1985, pp. 45-48 XP009177467.
Wood, Producing Ti-6A1-4V Plate from Single-Melt EBCHM Ingot, Vo. 54, No. 2, Feb. 1, 2002, pp. 56-58, XP008061875.
Kotani et al., Production of Titanium Slab Ingots in a Plasma Electron Beam Furnace, May 19, 1980, vol. 3, pp. 2147-2151.
Bomberger et al., The Melting of Titanium, Journal of Metals, vol. 36, No. 12, Dec. 1, 1984, pp. 39-47.
R. Bakish, The Substance of a Technology: Electron-Beam Melting and Refining, Nov. 1998, pp. 28-30.
EP Search Report of Appln. No. 10738638.5 dated Apr. 24, 2014 in English.
JP Office of Appln. No. 2010-549531 dated Jun. 20, 2012.
JP Search Report of Appln. No. 2010-549531 dated Mar. 16, 2012.
Iron and Steel Handbook edited by Iron and Steel Institute of Japan Inc., vol. III, (1) Basis of Rolling, Steel Plate, Japan, Maruzen Corporation Jun. 30, 1980, third edition, second printing, pp. 226-230, with partial English translation.
Huang Qingxue et al., Applied Technology for Production of Steel Rolling, Metallurgical Industry Press, 2004, pp. 114-118 with partial English translation.
Chinese office action of Appln. No. 201080007106.4 dated Jan. 22, 2013 with English translation.
Ukrainian Office Action dated Jan. 16, 2014 in English.
Электронно-лучевая плавка в литейном производстве / под. ред. С.В. Ладохина.—К.: Изд-во <<Сталь>>, 2007.—С. 2-4, 31-46.
Office Action in Korean Appln. No. 10-2011-7020209 dated Jan. 26, 2016 with English translation.

* cited by examiner

TITANIUM SLAB FOR HOT ROLLING PRODUCED BY ELECTRON-BEAM MELTING FURNACE, PROCESS FOR PRODUCTION THEREOF, AND PROCESS FOR ROLLING TITANIUM SLAB FOR HOT ROLLING

TECHNICAL FIELD

The present invention relates to a titanium slab produced by an electron-beam melting furnace suitable for hot rolling, and relates to a process for production thereof.

BACKGROUND ART

Manufacturers of titanium sponge or ingots have recently been inundated with requests for production increase to satisfy greater demand of titanium metal. Not only manufacturers of titanium sponge or ingots, but also manufacturers that process titanium ingots into forged plate material, are in a similar situation.

A conventional general process for the production of a strip coil, which is a kind of plate material processed from the titanium ingot mentioned above, involves first melting titanium raw material by a consumable electrode type arc melting method or an electron beam melting method, solidifying the melted metal as a large titanium ingot, and then breaking down the ingot into a slab for hot rolling.

This large ingot has a circular cross section having a diameter of about 1 m in the case of the consumable electrode arc melting method. In the case of the electron beam melting method, an ingot having a rectangular cross section can also be produced, and width of the rectangular cross section is about 0.5 to 1 m. Since the ingots have large cross section, these large ingots are broken down by hot processes such as milling, forging, and rolling, to have a slab shape so as to be enabled to be rolled by a hot rolling machine.

After the breaking down, a process for reforming the deformations for the thickness direction and for the width direction (camber) and a process for removing scale and damage on the surface are applied, thereafter a slab for hot rolling can be obtained. This slab for hot rolling is to be heated to a predetermined temperature and hot-rolled by a common hot rolling machine for steel or the like, into a strip coil (thin plate). After that, this hot rolled strip coil is to be annealed or descaled into a product, or is to be further cold-processed by such method as cold rolling and annealing into a product.

The cost for producing thin plate coil is accordingly increased with the number of production steps as mentioned above. Therefore, the manufacturer of the titanium ingot is required to provide a titanium slab which leads to shortening or improving the above steps.

On the other hand, recently, rectangular prism shape ingots have also been produced by making a mold having a rectangular cross section in an electron beam melting furnace. However, the thickness of the rectangular prism ingot is not small enough to be processed directly by the hot rolling machine without the breaking down process. Therefore, a process technology in which a thinner rectangular prism ingot can be produced is required; however, practical use in production has not yet been achieved.

That is, to produce a titanium slab having a thickness that can be directly fed into a hot rolling machine by using a conventional electron beam melting furnace, a specially designed mold to produce such a titanium slab is first required. However, in the case in which thickness of a conventional rectangular mold is simply reduced during the production of the titanium slab in the electron beam melting furnace, the titanium slab produced by the mold would have deformations for the thickness direction and for the width direction and would be wavy along the longitudinal direction. In such cases, the titanium slab cannot be directly used with conventional hot rolling machine used for rolling steel or the like.

When producing a strip coil by a conventional hot rolling machine for steel or the like, properties of the material going through the machine (linearity) would be impaired by the deformation of the slab, the material would be greatly deformed up and down or left and right, the material would not pass through straight, and continuous hot rolling could no longer be performed. Even if hot rolling was performed, since the rolled material would strike a guide or a feeding roll, the edge part would be cracked or the surface would be damaged. In a case in which the deformation of the produced titanium slab is significant, it would be necessary for the material to be processed and corrected by heating and or by grinding to remove a certain portions from the material in the thickness or width direction.

A process for production of rectangular prism ingot using an electron beam melting furnace having a rectangular mold is disclosed in Patent Document 1, for example. FIG. 1 of this publication discloses a situation in which molten metal is poured from a mold wall of the longer. The Patent Document 1 discloses an effect in which the rectangular prism ingot is produced to improve rolling processing of the ingot; however, there are no technical disclosures concerning linearity of the ingot in such terms as deformation of the titanium slab produced by the rectangular mold.

However, upon considering existing production processes, a process technology in which a titanium slab produced in an electron beam melting furnace under reduced pressure is drawn out at atmospheric pressure has not yet been in practical use. To draw out the slab, the electron beam irradiation should be stopped and the inside of the furnace should be held at atmospheric pressure, thus it is difficult to perform the electron beam melting process and the process of drawing out the slab continuously.

As mentioned above, to directly produce a titanium slab appropriate for hot rolling by an electron beam melting furnace, it is necessary to reasonably solve the above-mentioned matters.

The Patent Document 2 discloses a method in which a titanium slab is drawn out of a mold of an electron beam melting furnace, an electron beam is irradiated to heat and melt the surface thereof, and the slab is rolled by a surface shaping roll, so as to improve the surface of the casted slab.

According to Patent Document 2, since there is surface damage or large oscillation marks in the case in which the slab is merely drawn out of the mold, an electron beam, in the subsequent steps, is again irradiated to melt the surface, and the slab is rolled by the surface shaping roll to obtain a good casting surface. A sample of a rectangular prism titanium slab having a cross section of 180 mm×50 mm is exemplified.

However, Patent Document 2 does not disclose a technique concerning linearity of the produced material, such as deformations for the thickness direction and for the width direction of a titanium slab.

In addition, the cross section of 180 mm×50 mm as described is too small to be processed by an industrial scale hot rolling machine such as for steel to produce a strip coil.

Furthermore, in the Patent Document 2, it is necessary to further prepare the surface shaping roll and the electron gun for heating the titanium slab in addition to an electron beam melting furnace after the slab is drawn out of the mold, and thus, there are cost issues to be solved.

Furthermore, recently, a technique in which a rectangular mold is arranged in an electron beam melting furnace to produce a rectangular ingot has been developed. A rectangular prism ingot is easier to be hot forged compared to a round-shaped ingot, and thus efficiency of the forging process can be improved.

Furthermore, a process for production of a slab in which thickness of the ingot is further reduced has been researched; however, the slab produced have cracks or damages at corners thereof, and thus it is necessary to improve the situation.

In the case in which the slab is cracked or damaged, the damage may remain at the surface of a thin plate after subsequent forging or rolling processing, or the thin plate itself may be cracked. Furthermore, even if there are no cracks or damages at corners, edges may be cracked during hot rolling in the case in which the shape of the corner of the rectangular slab is not appropriate. In this case, yields of the thin plate product may be greatly reduced and improvement to overcome these problems has been required.

In this regard, a test in which cooling intensity at corners of the slab is lessened by subjecting inside parts of a mold to the outside observed in continuous casting technique, to produce an ingot having an improved surface, is disclosed in Patent Document 3.

Furthermore, a technique in which a cross section of the mold is formed so as to decrease along the pulling direction of the slab to improve fitting property of the mold and the slab, to improve the corner parts and surface of the slab, is disclosed in Patent Document 4.

However, these techniques concern improvement of the surface of the entire cast body, and problems about cracks generated at the corners of the rectangular ingot are neither disclosed nor suggested. As explained, a technique has been required in which a rectangular ingot having a good surface and not having cracks or damage at the corners produced by the electron beam melting furnace, can be reliably produced.

An object of the invention is to provide a titanium slab having properties suitable for hot rolling, which can be directly fed into a hot rolling machine without a breaking down process or subsequent correcting process after melting in an electron beam melting furnace, and to provide a process for production thereof.

Patent Document 1: Japanese Patent Application, Laid Open Publication No. Hei 04 (1992)-131330

Patent Document 2: Japanese Patent Application, Laid Open Publication No. Sho 62 (1987)-050047

Patent Document 3: Japanese Patent Application, Laid Open Publication No. Hei 11 (1999)-028550

Patent Document 4: Japanese Patent Application, Laid Open Publication No. Hei 04 (1992)-319044

SUMMARY OF THE INVENTION

The inventors have researched to achieve the objects mentioned above and have found that a titanium slab having superior linearity along a longitudinal direction can be produced by pouring molten metal from one of the mold walls of the short side, rather than from one of the mold walls of the long side, and thus the present invention below has been completed.

That is, the titanium slab for hot rolling of the present invention is a titanium slab directly produced from a mold of an electron beam melting furnace, and has a deformation for the thickness direction of not more than 5 mm and a deformation for the width direction of not more than 2.5 mm, both versus length of 1000 mm of the slab.

Here, in the present invention, "the deformation for the thickness direction versus the longitudinal direction" means maximal amount of deformation along a vertical direction (thickness direction) versus a longitudinal direction in the cross section of the slab, and the "the deformation for the width direction versus the longitudinal direction" means the maximal amount of deformation along a horizontal direction (width direction) versus a longitudinal direction in the plan view of the slab.

In the titanium slab for hot rolling of the present invention, it is desirable that a ratio (W/T) of the width (W) versus the thickness (T) be in a range from 2 to 10, and a ratio (L/W) of the length (L) versus the width be not less than 5.

In the titanium slab for hot rolling of the present invention, it is desirable that the thickness thereof be in a range from 150 to 300 mm, the width thereof be not more than 1750 mm, and the length thereof be not less than 5000 mm.

In the titanium slab for hot rolling of the present invention, it is desirable that chamfered parts having radius of curvature in a range of 5 to 50 mm be formed at corner parts.

It is desirable that the titanium slab for hot rolling of the present invention be produced by melting titanium in a hearth of an electron beam melting furnace to form molten metal in the hearth, and pouring the molten metal into a rectangular mold from one of the mold walls of a short side of the rectangular mold arranged downstream of the hearth.

It is desirable that the titanium slab for hot rolling consist of pure titanium or titanium alloy. Here, the pure titanium means a product corresponding to Japanese Industrial Standard (JIS) No. 1 to No. 4. In addition, the titanium alloy means a titanium material in which metallic elements other than pure titanium is purposely added.

In the process for production of a titanium slab for hot rolling of the present invention, it is desirable to use an electron beam melting furnace in which its rectangular mold has mold walls of a long side and mold walls of a short side, and to pour molten metal from one of the mold walls of a short side.

In the process for production of the titanium slab for hot rolling, it is desirable that the intensity of the electron beam irradiated at the surface of the poured molten titanium pool in the rectangular mold is controlled in the manner in which the intensity decreases from the shorter side wall of the mold to the opposite shorter side of the mold where the molten metal is poured.

In the process for production of the titanium slab for hot rolling, it is desirable to use a mold in which chamfered parts are formed at corners of the rectangular mold and the shape of the chamfered part is formed so as to be shaped similar to the equilibrium solid phase line which is the interface between the molten metal pool in the mold and the surrounding solidified phase.

In the process for production of the titanium slab for hot rolling, it is desirable to use a mold in which chamfered parts are formed at corners of the rectangular mold, the chamfered parts are part of a circular arc, and radius of curvature (rc) of the circular arc in a range of 2 to 50 mm.

In the process for production of the titanium slab for hot rolling, it is desirable that a mold be used in which a ratio (W/D) of the width (W) versus the thickness (D) of the rectangular mold is in a range from 2 to 10.

In the process for production of the titanium slab for hot rolling, it is desirable to use a mold in which the radius of curvature (rc) of the chamfered parts of the rectangular mold has a proportional relationship with a ratio (a) of the mold wall of a short side versus the mold wall of a long side.

In the process for rolling a titanium slab for hot rolling, it is desirable that the above-mentioned titanium slab for hot rolling be hot rolled into a strip coil by a hot rolling machine.

In the process for rolling a titanium slab for hot rolling, it is desirable that the rolling machine be one selected from a tandem rolling machine, a Steckel rolling machine, and a planetary rolling machine.

By the present invention, since the deformation of the titanium slab is extremely reduced, the titanium slab for hot rolling has superior linearity along a longitudinal direction so that the slab can be fed into a hot rolling machine directly without processing in a breaking down process or subsequent other correcting process. The present invention also provides a process for production of such a titanium slab.

A titanium slab produced by the above-mentioned apparatus and process has superior linearity along a longitudinal direction, and as a result, hot rolling can be reliably realized by a common hot rolling machine for steel or the like. Furthermore, the breaking down process or correcting process for the titanium slab along longitudinal direction can be omitted, and as a result, the time required to process a titanium thin plate can be greatly reduced.

BRIEF DESCRIPTION OF DRAWINGS

FIG. 4 is a diagram showing a cross sectional view of the rectangular mold and showing the mold walls of a long side and a short side, and the wall from which the molten metal is poured. Specifically.

EXPLANATION OF REFERENCE NUMERALS

1: Electron gun, 2: Electron beam, 3, 31: Rectangular mold, 32: Molten pool, 33: Isothermal line, 34: Solid phase, 35: Equilibrium solid phase line, 4: Hearth, 5: Molten metal, 6: Molten pool, 7: Slab, 8: Pullout base, 9: Pullout shaft, 10: Raw material, 11: Melting chamber, 12: Ingot chamber, 20: Gate valve.

EMBODIMENTS OF THE INVENTION

Desirable embodiments of the present invention are explained below with reference to the drawings.

Figure 1:
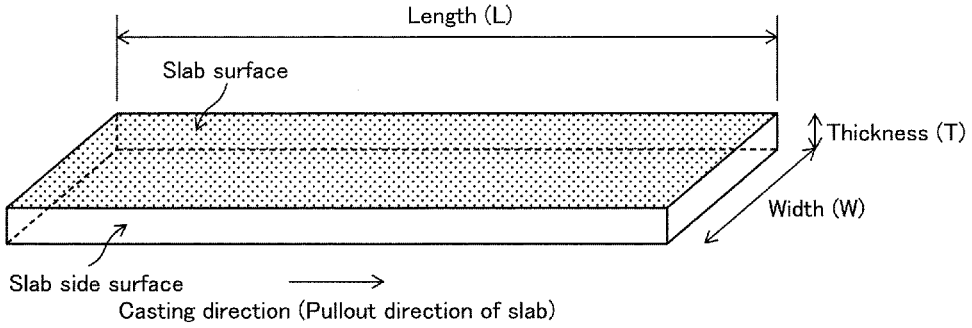
FIG. 1 is a conceptual diagram showing the shape of the titanium slab for hot rolling.

FIG. 1 conceptually shows the shape of the titanium slab for hot rolling of the present invention. Furthermore, FIGS. 2 and 3 respectively show a diagram explaining the deformation for the thickness direction of the slab along a longitudinal direction and the deformation for the width direction (camber) of the slab versus the longitudinal direction.

Figure 2:
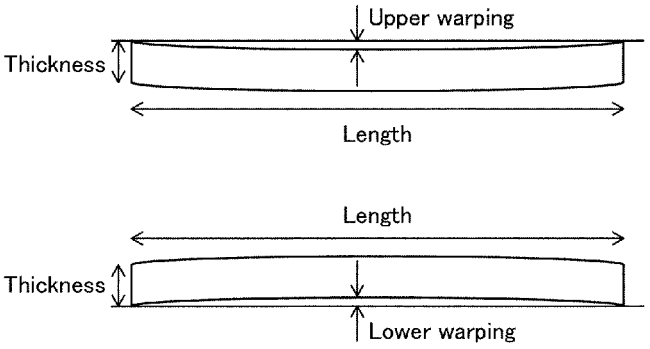
FIG. 2 is a conceptual diagram showing the deformation for the thickness direction of the slab versus a longitudinal direction.

The titanium slab for hot rolling produced by the method of the invention is first placed on a board having a smooth surface to confirm the deformation for the thickness direction and the deformation for the width direction thereof. That is, the titanium slab is rocked in a vertical direction to confirm degree of deformation along the vertical direction, distances between the board and corner parts which are floating above the board and are an opposite edge side of the board are measured, and the maximal value among the measured values of distance is defined as "the deformation for the thickness direction" as shown in FIG. 2.

Figure 3:
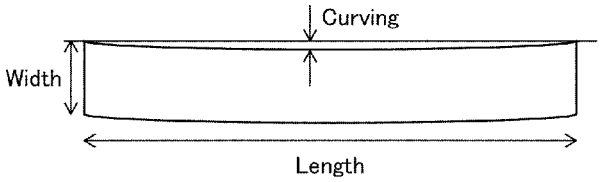
FIG. 3 is a conceptual diagram showing the deformation for the width direction of the slab versus a longitudinal direction.

Similarly, moving along edge surface of the titanium slab in a longitudinal direction placed on the board, an amount of displacement against a line indicated on the board along longitudinal direction of the slab is measured, and the maximal value among the measured values thereof is defined as "curving" as shown in FIG. 3.

Figure 4A:
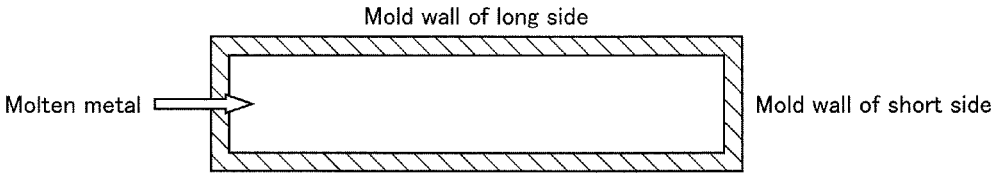
FIG. 4A is a diagram showing a situation of pouring the molten metal from the mold wall of a short side.

FIG. 4 is a plane view of the rectangular mold in the electron beam melting furnace that is used to melt and produce the titanium slab. The rectangular mold has a pair of mold walls of a short side and a pair of mold walls of a long side, and in the present invention, it is desirable that the molten metal be poured from one of mold walls of a short side as shown in FIG. 4A. As a result, the titanium slab having superior linearity along a longitudinal direction can be produced. The linearity exhibits the deformation for the thickness direction of not more than 5 mm and the deformation for the width direction of not more than 2.5 mm, per a length of 1000 mm of the slab. This is a quality that sufficiently ensures reliable properties of material going through a common hot rolling machine for such as steel or the like.

Figure 4B:
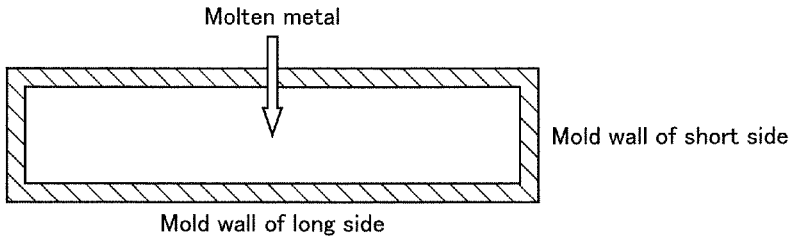
FIG. 4B is a diagram showing a situation of pouring from a long side.

Conventionally, there was a method in which the molten metal was poured from one of the mold walls of a long side, as shown in FIG. 4B, so that the molten metal was reliably poured without escaping from the inner area surrounded by mold walls. In this case, if the deformation for the thickness direction of the slab is more than 5 mm (per 1000 mm length), the necessary linearity might not be obtained. The reason for this is considered to be because differences in temperature are greatly generated between the mold wall from which the molten metal is poured and the mold wall facing to the other, and the difference in temperature and degree of cooling become great along a thickness direction which is the thin direction of the slab.

By pouring the molten metal from the mold wall of a short side as in the present invention, as is obvious from FIG. 4A, since the mold is thin, two corner parts of the mold are very close to the point where the molten metal is poured. The corner part of the mold has higher cooling ability compared to the plane part, and has an action of attenuating differences in temperature generated by pouring the molten metal. By this action, symmetric property of cooling is increased, and the deformation for the thickness direction and the deformation for the width direction are considerably reduced. Furthermore, since the molten metal is poured from the mold wall of a short side, distribution of temperature regarding mold walls of a long side that are mutually facing becomes symmetric, and as a result, deformation along a thickness direction which is a thin direction of the slab is considered to be unlikely to occur.

In the present invention, upon melting and producing the titanium slab, it is desirable to irradiate an electron beam so that the intensity of an electron beam irradiated at the surface of the poured molten titanium pool in the rectangular mold is controlled in the manner which decreases the intensity from the shorter side wall of the mold to the opposite shorter side of the mold where the molten metal is poured.

Since the temperature is high at the mold wall of a short side of pouring the molten metal and the temperature is low at the other mold wall of a short side distant and facing to the mold wall of pouring the molten metal, by heating the molten titanium pool in the rectangular mold with the above-mentioned irradiation pattern, distribution of temperature along a width direction of the titanium slab can be uniformly maintained. As a result, deformation of the produced titanium slab can be further efficiently reduced.

In practice, in the titanium slab for hot rolling produced by the apparatus and method according to the above-mentioned electron beam pattern of the present invention, the deformation for the thickness direction can be controlled within not more than 5 mm and desirably not more than 2 mm and the deformation for the width direction can be controlled within not more than 2.5 mm and desirably not more than 2 mm, versus a length of 1000 mm of the slab. Thus, the property of material going through the machine can be further stabilized.

In addition, in the case in which surface damage such as convex and concave parts existing on the surface of the titanium slab is required to be removed by grinding or the like, since the deformation for the thickness direction and the deformation for the width direction of the slab is small, efficiency of correcting can be improved and amount of grinding can be reduced.

The titanium slab for hot rolling of the present invention is characterized in that it is directly produced from the electron beam melting furnace. Since the titanium slab is controlled at an appropriate thickness for rolling at an early step of melting and producing, not only is no breaking down process, which is required to produce a slab from a conventional ingot, necessary any longer, but also correcting or machine processing such as grinding is not necessary since the deformation for the thickness direction and the deformation for the width direction of the titanium slab right after production is extremely small.

The titanium slab of the present invention is a titanium slab for hot rolling directly produced from the electron beam melting furnace, and it is desirable that a ratio (W/T) of the width (W) versus the thickness (T) of the titanium slab for hot rolling be in a range from 2 to 10 and a ratio (L/W) of the length (L) versus the width be not less than 5. In practice, it is desirable that the thickness of the titanium slab (T) be in a range of 150 to 300 mm, the width (W) be not more than 1750 mm, and the length (L) be not less than 5000 mm, more desirably not less than 5600 mm, and even more desirably not less than 6000 mm, and most desirably not less than 7000 mm.

In the case in which the ratio (W/T) of the width (W) versus the thickness (T) of the titanium slab is less than 2, the titanium slab is too thick compared to the width, and it is not desirable for the degree of spreading of width during hot rolling to be too large and the edge part to be cracked. In particular, in a case in which the thickness is greater than 300 mm, the free surface during hot rolling may be larger, wrinkles at a side surface may be deep, and cracks at the edge part may be promoted.

In a case in which the thickness of the titanium slab is less than 150 mm, the temperature of the slab may be greatly decreased during hot rolling, properties of material going through the machine may be deteriorated, and the edge parts may be cracked. Furthermore, during casting of the slab, linearity cannot be maintained because of the weight of the titanium slab itself, and it may be difficult to continue smoothly melting and producing the titanium slab (See desirable main device structure of the electron beam melting furnace shown in FIG. 5 mentioned below).

On the other hand, in the case in which the ratio (W/T) of the width (W) versus the thickness (T) of the titanium slab is greater than 10, thickness of the slab which is pulled out of the mold may be too thin, and it is not desirable that it not be sufficiently strong so as to withstand drawing. In a case in which the thickness of the titanium slab is greater than 300 mm or the width is greater than 1750 mm, a rolling load in hot rolling may become larger, and it is not desirable if the slab cannot be directly rolled by a common hot rolling machine any longer.

In the titanium slab for hot rolling of the present invention, from the viewpoint of production efficiency in the case in which the titanium slab for hot rolling is melted and produced by the electron beam melting furnace and from the viewpoint of a property of material going through the machine reliably in the case in which the slab is rolled into a strip coil by a common hot rolling machine for steel or the like, it is desirable that a ratio (L/W) of the length (L) of the titanium slab for hot rolling versus the width (W) be not less than 5 and that the length of the slab be not less than 5000. In a case in which L/W of the slab is small and the length is short, since the intensity of titanium is so low, that is, 60% that of steel, the slab may easily oscillate by a return action from a feeding roller or the like, and as a result, there may be a case in which the surface of the slab is damaged after hot rolling. Furthermore, in a case in which the length is less than 5000 mm, it is not desirable that the strip coil be difficult to be fitted and fed to a roll of the next step.

Furthermore, in a case in which the titanium slab is melted and produced continuously by the electron beam melting furnace, when casting of a first slab is completed, a vacuum chamber for the first slab is replaced by a vacuum chamber for next slab. The vacuum chamber for the first slab which is substituted requires a time for replacement in which the titanium slab at high temperature is cooled and the slab is taken out after that. To improve production efficiency, the time for completing casting of one titanium slab requires more than the time for replacement. Considering the amount of heat that can be supplied by an electron beam under these conditions, it is desirable that L/W be not less than 5.

Figure 5:
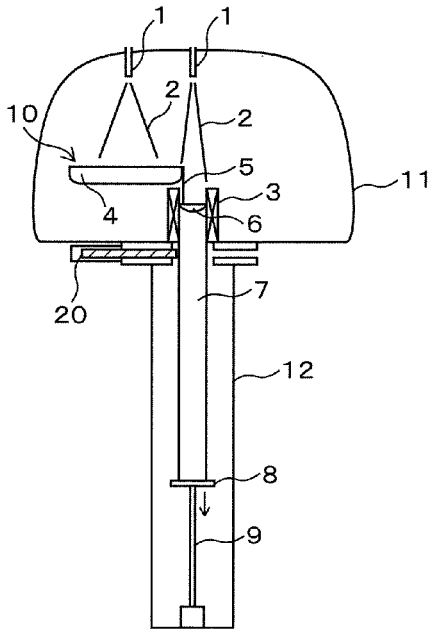
FIG. 5 is a diagram showing the main device structure of the electron beam melting furnace.
Figure 6:
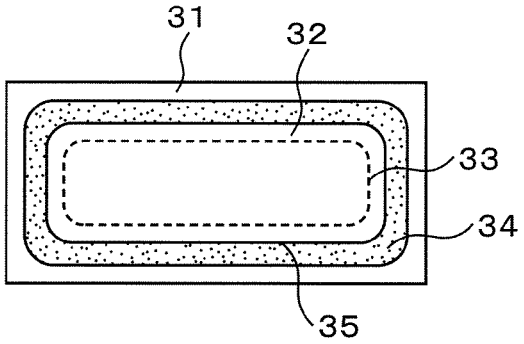
FIG. 6 is a conceptual diagram showing a situation during melting of the titanium slab in the rectangular mold of the invention.

FIG. 6 is a diagram of which the mold 3 in FIG. 5 is seen from above. As shown in FIG. 6, in the present invention, it is desirable to use a mold in which chamfered parts are formed at corners of the rectangular mold 31 and the shape of the chamfered part is formed so as to be homothetic with an equilibrium solid phase line 35 which is an interface of the molten metal 32 formed in the rectangular mold and the solidified shell 34 formed at outer circumference thereof.

Here, the equilibrium solid phase line 35 means an interface of the solid phase 34 and the liquid phase 32 formed in the rectangular mold 31, and corresponds to a line connecting points each having a temperature corresponding to a solidifying point of the molten metal. Generally, solid phase and liquid phase coexist at the melting point of a metal; however, the outer circumference of the mold pool 32 shows a solid phase, and therefore, this isothermal line is defined as the equilibrium solid phase line 35 in the present invention.

The above-mentioned equilibrium solid phase line 35 forms a line parallel to the mold wall at long side parts and short side parts of the mold. However, at the corner parts, it forms a curve that is convex to an outer circumference. The present invention focused on the shape of the curve, and it is desirable that the shape of the corner parts of the rectangular mold 31 be formed so as to be homothetic with an equilibrium solid phase line 35 formed in the rectangular mold 31.

By forming the corner parts so as to correspond to the equilibrium solid phase line, since a heat flow by heat absorption from the mold pool 32 to the water cooling mold 31 is formed in a direction vertical to the inner surface of the mold, a casting structure which is formed accompanied by this is also formed along the heat flow, and thus an ingot having a uniform solidified structure can be produced.

Furthermore, in the present invention, the chamfered part of the corner parts of the rectangular mold 31 can be constructed by a part of circular arc. In the present invention, it is desirable that the radius of curvature (rc) of the arc of the chamfered part be in a range from 2 to 50 mm.

In the case in which the radius of curvature of the arc forming the chamfered part of the corner parts are more than the maximal value of 50 mm, despite the solidified structure of the corner parts of the titanium slab produced being able to be maintained well, it is not desirable that properties of uniformity of thin plate formed by rolling or the titanium slab be deteriorated. Furthermore, it is not desirable that the slab may be broken out from inside since a rate of cooling and solidifying of the corner parts of the slab are decreased. On the other hand, in the case in which the chamfered part having a radius of curvature less than the minimal value of 2 mm is formed, since heat absorption from the slab to the corner parts of the mold is large, it becomes difficult to improve the surface of the slab, and it is not desirable that the corner parts of the titanium slab itself produced may crack or be damaged.

Therefore, in the present invention, the radius of curvature of the arc forming the chamfered part of the corner parts of the rectangular mold 31 is desirably set in a range of 2 to 50 mm, and more desirably in a range from 5 to 30 mm. By forming the inner surface of the mold with a smooth curvature in the range, a titanium slab having good solidified structure not having cracks or damage at the corner parts can be produced.

In the present invention, it is desirable that the radius of curvature (rc) of the chamfered part be formed so as to be proportional to a ratio (a) of length of the mold wall of a short side versus length of the mold wall of a long side. That is, it is desirable to form a larger chamfered part as the thickness of the ingot produced is increased. By this construction, the present invention can be adapted to rectangular molds of various shapes.

In the present invention, a ratio (W/D) of the width (W) versus the thickness (D) of the mold is desirably in a range of 2 to 10, and more desirably in a range of 2.5 to 8.

The shape of the mold used in the present invention is desirably rectangular, and the thickness of the mold is desirably thinner from the viewpoint of subsequent rolling processes. However, it is not desirable for the thickness to be too small since the amount of heat absorption by the water-cooled copper wall of the mold is increased and the amount of heat required to supply to the mold pool is also increased.

Therefore, the size of the mold has its upper and lower limits, in the present invention, and as a result of various research, the upper limit of the ratio (W/D) of the width versus the thickness of the mold is 10. In a case in which the width of the mold is short so that the ratio is greater than the upper limit, the amount of heat absorption from the mold pool by the mold may be increased and the heating amount by the electron beam corresponding to the amount of absorption may also be undesirably increased. On the other hand, in the case in which the ratio (W/D) is less than the lower limit 2, the cross section of the slab may become a regular square, the relationship of the width and thickness of the mold become closer, and the effect of the present invention cannot be obtained any longer. Furthermore, in the case in which the ratio is less than 1, the relationship of the width and thickness are the reverse, and this makes no sense for the invention. By setting the ratio (W/D) of the width versus thickness of the mold in the range of 2.5 to 8 desirably, even in a case in which the mold is deformed in some extent, a slab having the target width and thickness can be reliably produced.

In the present invention, in the case in which electron beam is irradiated to a pool part close to the chamfered parts of the mold pool 32 held in the rectangular mold 31, it is desirable that the electron beam have a pattern that is homothetic with the shape of the chamfered part of the rectangular mold 32 to the chamfered parts.

Furthermore, in a case in which the chamfered part is formed by part of a circular arc, it is desirable that the pattern of the electron beam also be circular, and that the radius of the circle be the same as the radius of curvature of the circular arc forming the chamfered part.

By irradiating the electron beam having the above-mentioned pattern on the mold pool 32, heat energy can be put into every corner of the chamfered parts of the rectangular mold 31, and as a result, the surface of the corner parts of the titanium slab produced can also have a good solidified structure not having cracks or damage.

As the titanium slab mentioned above, pure titanium and titanium alloy can be employed. In practice, the present invention can be employed in the case in which a titanium slab is produced by using raw material of titanium sponge, and in the case in which a titanium alloy slab is produced by using titanium sponge and an additive of an alloy component.

Next, desirable process for production of titanium slab is explained with reference to FIG. 5. FIG. 5 shows the main device structure of the electron beam melting furnace appropriate for production of the titanium slab of the present invention. In the present invention, titanium raw material 10 is placed in a hearth 4 and forms molten metal 5 by being heated and melted by electron beam 2 emitted from an electron gun 1 arranged at the top of the electron beam melting furnace. The molten metal 5 is continuously poured into a mold 3 arranged downstream of the hearth 4.

The molten metal 5 continuously poured into the mold 3 is joined together with titanium pool 6 formed inside the mold 3, and titanium slab 7 which solidifies downward as the titanium pool 6 is continuously drawn out. This process is performed so that the surface of the titanium pool 6 is maintained at a certain level.

The hearth 4 and the mold 3 are arranged in the melting chamber 11 and are apart from the atmosphere, and inside the melting room is kept at reduced pressure. The titanium slab 7 pulled out from the lower side of the mold 3 is continuously fed into the ingot chamber 12 which is fittingly arranged at a lower part of the melting chamber 11. It is desirable that the inside the ingot chamber 12 also be maintained at a reduced pressure similar to that of the melting chamber 11. By maintaining the reduced pressure condition, air is effectively prevented from entering from the ingot chamber 12 to the melting chamber 11.

After the titanium slab 7 is drawn out of the mold 3 completely into the ingot chamber 12, it is desirable that gate valve 20 be actuated to cut off the interface of the melting chamber 11 and the ingot chamber 12.

Next, it is desirable that argon gas be filled in the ingot chamber 12 to recover pressure inside the ingot chamber 12 until a normal pressure is reached, and that the temperature inside the ingot chamber 12 be cooled to a temperature near room temperature.

The titanium slab 7, which is cooled to room temperature, is drawn out into the normal atmosphere from the opening door arranged on the ingot chamber 12, not shown in the figure.

In the present invention, from the viewpoint of maintaining a desirable length of the titanium slab, it is desirable that the length of the ingot chamber 12 be maintained to be at least not less than 5000 mm.

In the present invention, it is desirable that the thickness of the mold 3 be constructed so as to melt and produce the titanium slab 7 appropriately, in particular, in a range from 150 to 300 mm.

Furthermore, it is desirable that the ratio (W/T) of the width (W) versus the thickness (T) of the rectangular mold be in a range from 2 to 10. By using the rectangular mold having the above-mentioned shape, the titanium slab produced can be fed directly into a common hot rolling machine for steel or the like.

Next, after the titanium slab drawn out of the electron beam melting furnace shown in FIG. 5, is processed in a process in which an attached material or convex and concave part is removed by grinding or the like, by heating the titanium slab, and feeding it into the hot rolling machine with maintaining high temperature, it can be hot-rolled into a strip coil.

In the present invention, as the above-mentioned rolling machine, a tandem rolling machine, a Steckel rolling machine, and a planetary rolling machine can be desirably selected and used. In particular, the tandem rolling machine can be desirably used both in a rough rolling and in a finish rolling while the titanium slab is hot rolled into a strip coil.

By the titanium slab melted and produced by the electron beam melting furnace mentioned above, a hot rolling machine owned by a steel manufacturer can be appropriately used, and as a result, hot rolled titanium coils having superior quality can be produced.

EXAMPLE

Example 1

1. Raw material: Titanium sponge
2. Melting apparatus:
1) Electron beam output
   Hearth side: 1000 kW maximum
   Mold side: 400 kW maximum
2) Rectangular mold
   Size: Thickness 270 mm×Width 1100 mm
   Structure: Water cooled copper
3) Direction of pouring molten metal to the mold: From the mold wall of a short side of a rectangular mold Using the above-mentioned apparatus and raw material, a total of 5 titanium slabs each having a width of 1100 mm, a thickness of 270 mm, and lengths of 5600, 6000, 7000, 8000, and 9000 mm were produced. Measuring the deformation for the thickness direction and the deformation for the width direction along a longitudinal direction of the titanium slab performed in the way as mentioned above, the deformation for the thickness direction was 0.5 to 4 mm and the deformation for the width direction was 0.5 to 2 mm per 1000 mm length of the slab, and thus linearity of the titanium slabs was sufficient to feed them into the hot rolling machine in the subsequent processes.

Example 2

In addition to conditions in Example 1, along the width direction of the rectangular mold, the intensity of the electron beam irradiated to the surface of the poured molten titanium pool in the rectangular mold is controlled in the manner which decreases the intensity from the shorter side wall of the mold to the opposite shorter side of the mold where the molten metal is poured, to maintain the surface temperature of the rectangular mold pool uniform, and melting and production was performed. As a result, the deformation for the thickness direction and the deformation for the width direction of the titanium slab produced were both reliably minimized, and the warping was not more than 2 mm.

Example 3

After finishing the surface of the titanium slab produced in the Example 1 by grinding, the titanium slab was fed to a hot rolling machine for steel, to obtain strip coils having thicknesses of 3 to 6 mm. Furthermore, the strip coils were descaled by shot blasting and by washing with nitric acid and hydrofluoric acid, and were cold-rolled to finally obtain thin plates having thicknesses of 0.3 to 1 mm efficiently.

Example 4

Except that aluminum-vanadium alloy was added to the titanium sponge to produce a 3Al-2.5V (Japanese Industrial Standard No. 61) alloy slab, in a manner similar to that of Example 1, a total of 5 titanium alloy slabs each having a width of 1100 mm, a thickness of 270 mm, and lengths of 5600, 6000, 7000, 8000, and 9000 mm were produced. Linearity of the titanium alloy slabs was sufficient to feed them into the hot rolling machine in subsequent processes.

Example 5

A pure titanium slab was produced using the mold shown in FIG. 6, having a cross section of corner parts is formed in a shape homothetic to an equilibrium solid phase line. As a result of observing the surface of the slab after production, the solidified structure was good, and there was no cracking or damage. In addition, 1 mm of the surface layer of the slab was cut off and the slab was rolled to produce thin plates, and there was no cracking or damage. It should be noted that the yield of the slab after cutting off the surface was 98%.

Comparative Example 1

Except that the molten metal was poured from the mold wall of a long side of the rectangular mold, in a manner similar to that of Example 1, a titanium slab was produced. As a result, the titanium slab having predetermined length could be produced smoothly; however, the deformation for the thickness direction was 6 to 15 mm and the deformation for the width direction was 3 to 5 mm per 1000 mm length, and the slab could not be fed into a hot rolling machine as it was. Therefore, processing by a correcting machine to improve linearity was necessary, and then a thin plate coil could be obtained.

Comparative Example 2

Except that a conventional mold in which the inside is also rectangular was used instead of the mold of the present invention in which the inside was constructed by a curved surface, in a manner similar to that of Example 5, the titanium slab was produced. As a result, the surface of a parallel part of the slab was in good condition; however, the surface was rough around the corner parts and there were fine cracks observed. Then, the surface was ground 5 mm and rolled to produce thin plate. There was no cracking or damage generated. However, because of the grinding process performed before rolling, the yield was decreased to 95%.

By the present invention, high quality titanium slabs can be directly produced using an electron beam melting furnace, and this thus contributes to reducing the production costs of titanium products.

The invention claimed is:

1. A process for production of a titanium slab for hot rolling, comprising:

using an electron beam melting furnace, in which a rectangular mold having a ratio (W/D) of the width (W) versus the thickness (D) of the rectangular mold is in the range from 2 to 10 is equipped, in a melting chamber maintained at a reduced pressure, pouring molten metal from the top of shorter side wall of the mold, wherein intensity of electron beam irradiated to the surface of the poured molten titanium pool in the rectangular mold is controlled in the manner which decreases the intensity from one of the shorter side walls of the mold to the opposite shorter side wall of the mold where the molten metal is poured, withdrawing out from the rectangular mold a titanium slab having a deformation of not more than 5 mm for the thickness direction versus the longitudinal direction, a deformation of not more than 2.5 mm for the width direction versus the longitudinal direction, both per a length of 1000 mm of the slab, and having a ratio (L/W) of the length (L) versus the width (W) is not less than 5, into an ingot chamber maintained at a reduced pressure, cutting off an interface of the melting chamber and the ingot chamber, filling the ingot chamber with argon gas to recover pressure inside the ingot chamber until a normal pressure, cooling the slab down to room temperature in the ingot chamber, and then moving the slab to the atmosphere.

2. The process for production of the titanium slab for hot rolling according to claim 1, wherein chamfered parts are formed at corners of the rectangular mold and the chamfered part is shaped similar to the equilibrium solid phase line which is the interface between the molten metal pool in the mold and the surrounding solidified phase.

3. The process for production of the titanium slab for hot rolling according to claim 1, wherein a mold is used in which chamfered parts are formed at corners of the rectangular mold, the chamfered parts are part of circular arc, and the radius of curvature (rc) of the circular arc is in a range of 2 to 50 mm.

4. The process for production of the titanium slab for hot rolling according to claim 3, wherein a mold is used in which the radius of curvature (rc) of the chamfered parts of the rectangular mold has a proportional relationship with a ratio ($\alpha$) of the length of a short mold wall in the thickness direction of the titanium slab versus a length of the long mold wall in the width direction of the slab.

5. The process for production of the titanium slab for hot rolling according to claim 1, wherein the produced titanium slab has a ratio (W/T) of the width (W) versus the thickness (T) being in the range from 2 to 10, and a ratio (L/W) of the length (L) versus the width (W) being not less than 5, and the length thereof being not less than 5000 mm.

* * * * *